US011432580B2

(12) United States Patent
Evans et al.

(10) Patent No.: US 11,432,580 B2
(45) Date of Patent: Sep. 6, 2022

(54) CURED LEAF SEPARATOR

(71) Applicant: Altria Client Services LLC, Richmond, VA (US)

(72) Inventors: James David Evans, Chesterfield, VA (US); Ashish Jain, Glenn Allen, VA (US); Loren Theodore Duvekot, Goochland, VA (US); David C. Haller, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 51 days.

(21) Appl. No.: 16/825,369

(22) Filed: Mar. 20, 2020

(65) Prior Publication Data

US 2020/0214336 A1 Jul. 9, 2020

Related U.S. Application Data

(62) Division of application No. 15/087,614, filed on Mar. 31, 2016, now Pat. No. 10,624,384.

(60) Provisional application No. 62/160,448, filed on May 12, 2015.

(51) Int. Cl.

| | |
|---|---|
| ***A24B 5/04*** | (2006.01) |
| ***A24B 5/06*** | (2006.01) |
| ***A24B 5/12*** | (2006.01) |
| ***A24B 5/16*** | (2006.01) |

(52) U.S. Cl.

CPC ..... *A24B 5/04* (2013.01); *A24B 5/06* (2013.01); *A24B 5/12* (2013.01); *A24B 5/16* (2013.01)

(58) Field of Classification Search

CPC .... A24B 5/06; A24B 5/08; A24B 5/12; A24B 5/18; A24B 7/06

USPC ..... 460/128, 134, 135, 136, 140; 131/322, 131/323, 313, 317

See application file for complete search history.

(56) References Cited

U.S. PATENT DOCUMENTS

| | | | | |
|---|---|---|---|---|
| 94,555 | A * | 9/1869 | Borgfeldt | A24B 5/10 131/311 |
| 223,854 | A | 1/1880 | Locke | |
| 1,224,848 | A | 5/1917 | Buchanan | |
| 1,267,776 | A | 5/1918 | Lawrence | |
| 1,781,701 | A | 11/1930 | Phillips | |
| 1,881,496 | A | 10/1932 | Gooch et al. | |

(Continued)

FOREIGN PATENT DOCUMENTS

WO WO-2012/031918 A1 3/2012

*Primary Examiner* — Kelly M Gambetta
*Assistant Examiner* — Russell E Sparks
(74) *Attorney, Agent, or Firm* — Harness, Dickey & Pierce, P.L.C.

(57) ABSTRACT

A leaf removal assembly including a frame comprising a front plate having a feed opening, a leaf stripping assembly mounted on said front plate in front of said feed opening and an upper sprocket wheel comprising a plurality of upper socket grippers extending radially outward of the upper sprocket wheel and being disposed behind the front plate. The leaf removal assembly further includes a lower sprocket wheel comprising a plurality of lower sprocket grippers extending radially outwardly of the lower sprocket wheel and being disposed behind the front plate. At least one of the upper sprocket wheel and the lower sprocket wheel may be adjustably attached to the frame. A process for separating a leaf from a stalk comprising at least one leaf is also included.

10 Claims, 7 Drawing Sheets

(56) References Cited

U.S. PATENT DOCUMENTS

| | | | | | |
|---|---|---|---|---|---|
| 1,962,955 | A | | 6/1934 | Gooch, Jr. | |
| 2,359,824 | A | | 10/1944 | Brashear | |
| 2,422,430 | A | | 6/1947 | Manderscheid | |
| 2,759,483 | A | | 8/1956 | Slovic | |
| 2,837,097 | A | | 6/1958 | Koch | |
| 2,962,029 | A | | 11/1960 | McCashen | |
| 3,928,183 | A | * | 12/1975 | Asfour | B07C 5/368 209/580 |
| 4,350,172 | A | | 9/1982 | Guthrie | |
| 4,373,323 | A | | 2/1983 | Jones | |
| 4,407,305 | A | * | 10/1983 | Patterson | A01D 45/16 460/132 |
| 4,498,484 | A | * | 2/1985 | Gilbert | A01D 45/16 460/136 |
| 4,773,434 | A | * | 9/1988 | Miyake | A01D 45/16 131/313 |
| 4,836,220 | A | | 6/1989 | Miyake et al. | |
| 5,331,980 | A | | 7/1994 | Bailey | |
| 6,481,441 | B1 | | 11/2002 | Cunningham | |
| 8,388,298 | B2 | | 3/2013 | Ikehata | |
| 2010/0175355 | A1 | | 7/2010 | Desmarais et al. | |

* cited by examiner

CURED LEAF SEPARATOR

RELATED APPLICATION

This patent application is a divisional application of U.S. application Ser. No. 15/087,614, filed Mar. 31, 2016, which claims priority to U.S. Provisional Application Ser. No. 62/160,448, filed on May 12, 2015, the entire contents of each of which are incorporated herein by reference.

FIELD

The present invention relates generally to an assembly and a method for removing leaves from a stalk. More specifically, the present invention relates to an assembly and a method for removing cured tobacco leaves from a tobacco stalk.

Environment

Harvested tobacco is often processed in the form of cured stalks having individual leaves and/or branches attached thereto. To produce tobacco suitable for use in tobacco products, e.g., cigars or cigarettes, the leaves are separated from the stalks.

The tobacco stalks often vary in size, e.g., thickness, girth, or length. For example, larger stalks may have a diameter of at least 5 cm, while smaller stalks may have a much smaller diameter, e.g., less than 2.5 cm. Also, the stalks themselves may change size, e.g., thickness, down the length of the stalk. In some cases, the base section of the stalk may flare out, thus creating a larger diameter at the base end of the stalk. These variations in stalk size may make it difficult to process all types and sizes of stalks in a single assembly.

The need exists for a simplified leaf removal assembly that provides the capability of processing tobacco stalks having a wide range of sizes and that relies on a simplified mechanism for conveying the stalks through the leaf removal device(s).

BRIEF DESCRIPTION OF DRAWINGS

The forms disclosed herein are illustrated by way of example, and not by way of limitation, in the figures of the accompanying drawings and in which like reference numerals refer to similar elements and in which.

SUMMARY

Figure 1:
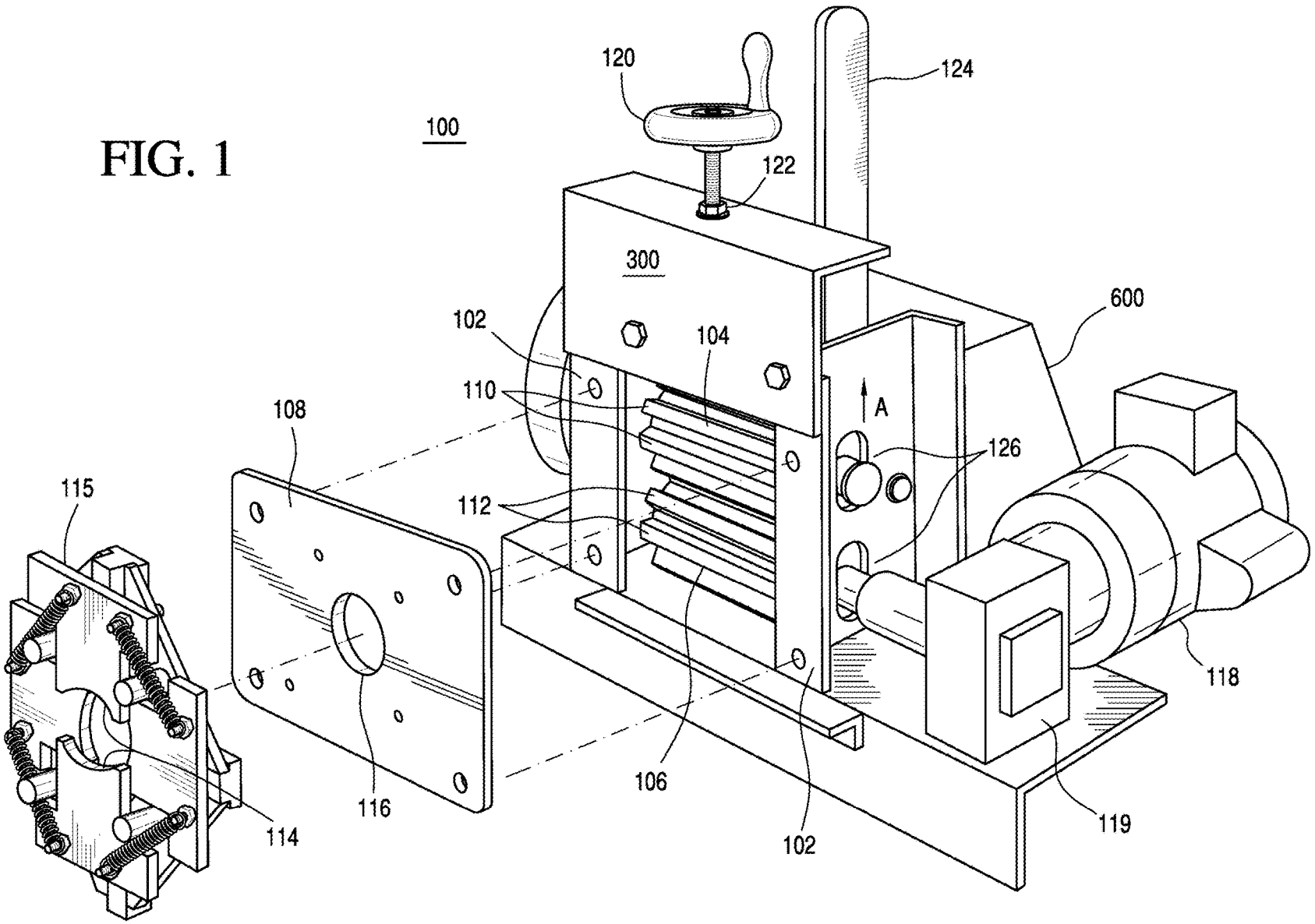
FIG. 1 presents a perspective view (also showing an exploded front plate and a leaf stripping assembly) of one form of a leaf removal assembly in accordance herewith.

In one form, a leaf removal assembly, such as for tobacco plant stalks, is disclosed. The leaf removal assembly comprises a frame and the frame comprises a front plate. The front plate has a feed opening, through which a stalk may be fed. The leaf removal assembly further comprises a leaf stripping assembly mounted on the front plate in front of the feed opening and an upper sprocket wheel. The upper sprocket wheel may comprise a plurality of upper sprocket grippers and the grippers may extend, e.g., radially outwardly, from the upper sprocket wheel. The upper sprocket wheel (and also the upper sprocket grippers) are disposed behind the front plate. As one example, the grippers may comprise teeth. The leaf removal assembly further comprises a lower sprocket wheel. The lower sprocket wheel may comprise a plurality of lower sprocket grippers and the grippers may extend, e.g., radially outwardly, from the lower sprocket wheel. The lower sprocket wheel (and also the lower sprocket grippers) is disposed behind the front plate. At least one of the upper sprocket wheel and the lower sprocket wheel is adjustably attached to the frame.

In another form, the leaf removal assembly further comprises a sprocket controller. The sprocket controller may be in communication with a respective sprocket wheel and may serve to adjust a location of the respective sprocket wheel.

In one form, the sprocket controller is connected to the respective sprocket wheel via a spring loaded device.

In yet another form, the frame, e.g., outer portions of the frame define a movement path opening. The movement path opening allows adjustment of at least one sprocket wheel.

In still another form, the movement path opening is defined such that the opening allows substantially vertical adjustment of the at least one sprocket wheel.

In another form, the movement path opening is defined such that the opening allows substantially arcuate adjustment of the at least one sprocket wheel.

In another form, the sprocket wheels are adjustable such that at least one of the upper sprocket grippers is spaced from at least one of the lower sprocket grippers.

In one form, the leaf stripping assembly comprises a cutting edge, such as by having one or more beveled surfaces.

The leaf stripping assembly may comprise at least one adjustably attached stripping plate having a cutting edge and a guide shoe attached to the back of the stripping plate, extending beyond the cutting edge. The stripping assembly preferably comprises four of these stripping plates adjustably attached to the stripping assembly and forming an adjustable aperture.

In one form, the leaf removal assembly further comprises a shredder disposed downstream of the sprocket wheels. The shredder may shred at least a portion of the stalk and/or leaves.

In one form, the shredder comprises a rotating head assembly having at least one shredding blade for shredding a stripped stalk.

In yet another form, the leaf removal assembly further comprises a lever arm connected to at least one of the upper sprocket wheel and the lower sprocket wheel. The lever arm may be employed to pivotally separate, e.g., manually separate, the upper sprocket wheel from the lower sprocket wheel.

In another form, the leaf removal assembly is structured such that one of the upper socket wheel and the lower sprocket wheel is rotatably fixed to said frame and the other is rotatably fixed to a cradle, the cradle pivotally fixed to said frame.

In another form the cradle is biased in a direction such that the sprocket wheel fixed therein is biased in the direction of the sprocket wheel fixed in said frame.

Additionally, a lever arm can be connected to the cradle to pivot the cradle so as to release a jammed stalk.

In another form, a process for separating a leaf from a stalk having a stalk end and comprising at least one leaf is disclosed. The process comprises the step of providing a leaf removal assembly as discussed herein. The process further comprises the step of feeding the stalk end through the leaf stripping assembly and feed opening and toward the sprocket wheels such that the upper sprocket grippers and/or the lower sprocket grippers engage at least a portion of the stalk. Optionally, the upper sprocket wheel and/or the lower sprocket wheel is adjusted to grip (more tightly) the stalk. The process further comprises the step of rotating the upper sprocket wheel and/or the lower sprocket wheel to convey the stalk through the leaf stripping assembly and the feed opening to strip the leaves from the stalk.

In another form, the feeding step further comprises adjusting the location of the upper sprocket wheel and/or the lower sprocket wheel so as to further engage the stalk end between the sprocket wheels.

In one form, the conveyance of the stalk through the feed opening engages the leaves with the leaf stripping assembly, such that the engagement of the leaves with the leaf stripping assembly cuts at least one leaf from the stalk.

In another form, the invention provides for a method of removing leaf from a collection of stalks of different sizes. The method comprises stripping leaf from each stalk by feeding each stalk through a stripping mechanism, the feeding comprising gripping an end portion each stalk between a pair of opposing, rotating grippers while biasing one of the grippers toward the other gripper, upon the occurrence of a jam from an oversize stalk, relieving the jam by moving one of the grippers away from the other, while continuing the biasing, the feeding further comprising continuously driving the rotation of the grippers throughout the gripping, biasing and relieving.

In one form of this process, stripping includes drawing the stalk between opposing, radially moveable cutting edges while biasing the cutting edges radially inward.

In another form of this process, stripping includes abating cutting of the stalk by limiting radial inward movement of the cutting edges by contacting the stem during the drawing step with a portion of a guide shoe that moves with and extends radially inwardly beyond each cutting blade.

DETAILED DESCRIPTION

Various aspects will now be described with reference to specific forms selected for purposes of illustration. It will be appreciated that the spirit and scope of the apparatuses, assemblies, systems, and processes disclosed herein are not limited to the selected forms. Moreover, it is to be noted that the FIGS. provided herein are not drawn to any particular proportion or scale, and that many variations can be made to the illustrated forms. Reference is made herein to FIGS. 1-7, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "having," "comprises," and "comprising," and their linguistic or grammatical variants, derivatives, and/or conjugates, as used herein, means "including, but not limited to."

Throughout the illustrative description, the examples, and the appended claims, a numerical value of a parameter, feature, object, or dimension may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number of steps or procedures, and sub-steps or sub-procedures of operation or implementation of forms of the method or to the details of type, composition, construction, arrangement, order and number of the system, system sub-units, devices, assemblies, sub-assemblies, mechanisms, structures, components, elements, and configurations, and peripheral equipment, utilities, accessories, and materials of forms of the system, set forth in the following illustrative description, accompanying drawings, and examples, unless otherwise specifically stated herein. The apparatuses, assemblies, systems, and processes disclosed herein can be practiced or implemented according to various other alternative forms and in various other alternative ways.

It is also to be understood that reference to "upper" and "lower" is predicated upon the embodiments being placed in a certain orientation. If oriented differently, "upper" and "lower" may refer instead to "left" and "right, or vice versa, such as if the apparatus disclosed herein were placed on its side.

It is also to be understood that all technical and scientific words, terms, and/or phrases used herein throughout the present disclosure have either the identical or similar meaning as commonly understood by one of ordinary skill in the art, unless otherwise specifically defined or stated herein. Phraseology, terminology, and notation employed herein throughout the present disclosure are for the purpose of description and should not be regarded as limiting.

As noted above, to produce tobacco suitable for use in tobacco products, e.g., cigars or cigarettes, tobacco leaves are separated from their respective stalks. Variations in tobacco stalk size, e.g., thickness (diameter), girth, or length, may make it difficult to process all types and sizes of stalks in a single assembly. Although the conventional leaf removal assemblies have difficulty processing non-standard sized stalks, e.g., particularly large stalks or stalks having flared base sections. In an effort to address this problem, some assemblies employ additional sorting and/or removal mechanisms to separate stalks by size and process the separated stalks. While these additional mechanisms may help to address the problems associated with oversized or undersized stalks, they add complexity and potential for mechanical break-down to the respective assembly.

It has now been discovered that a leaf removal assembly that comprises an upper sprocket wheel and/or a lower sprocket wheel that are/is adjustably attached to the frame of the assembly provides for a significant improvement in the ability to accommodate and process non-standard sized stalks. The adjustable attachment of the upper sprocket wheel and/or lower sprocket wheel allows for adjustment of the sprocket wheel(s), which in turn allows variance in the spatial relationship between the upper sprocket wheel and the lower sprocket wheel, e.g., the distance between the upper sprocket wheel and the lower sprocket wheel, (and the respective components thereof). Because the leaf removal assembly allows the spatial relationship between the sprocket wheels to vary, the leaf removal assembly can process stalks having a wide range of stalk sizes without the need for additional sorting and/or removal mechanisms. For example, if a particularly large stalk is processed, the upper sprocket wheel may be adjusted upwardly and away from the lower sprocket wheel and/or the lower sprocket wheel may be adjusted downwardly and away from the upper sprocket wheel, thus creating a larger space therebetween. As another example, if a particularly small stalk is processed, the upper sprocket wheel may be adjusted downwardly and toward the lower sprocket wheel and/or the lower sprocket wheel may be adjusted upwardly and toward the upper sprocket wheel, thus creating a smaller space, e.g., little or no space, therebetween. In contrast, conventional leaf removal assemblies that employ fixed, e.g., non-adjustable, sprocket wheels cannot adjust the spatial relationship between wheels. As such, these leaf removal assemblies have difficulty processing particularly large stalks and/or particularly small stalks without using additional sorting and/or removal mechanisms.

The leaf removal assembly, in one form, may be used in conjunction with a suitable plant product, e.g., tobacco plant product, having a stalk with at least one leaf attached thereto.

The leaf removal assembly comprises a frame, the shape, structure, and composition of which may vary widely. Generally speaking, the frame supports and/or encloses one or more of the components of the leaf removal assembly. For example, the frame may support one or more of the components discussed in the paragraphs below. In particular, the frame may, in some instances, support at least one of the sprocket wheels. In some cases, the frame may at least partially surround and/or enclose some components of the leaf removal assembly.

In some forms the frame comprises a front plate, which may be formed as a portion of the frame, or be attached to and supported by the frame. Various attachment mechanisms are known in the art and may be utilized to attach the front plate to the frame. In one form, the front plate is an outside tooling plate, with a feed opening sufficient in size to accommodate different sized tobacco stalks.

The leaf removal assembly comprises an upper sprocket wheel and/or a lower sprocket wheel. In one form, the upper sprocket wheel and/or the lower sprocket wheel comprise a plurality of sprocket grippers, which in use contact a stalk, e.g., a stalk fed through the feed opening. As the grippers are moved, e.g., rotated or turned, the grippers convey the stalk through the feed opening and past the remaining components of the leaf removal assembly. The grippers may extend radially outwardly from the respective sprocket wheel, e.g., the upper sprocket wheel and or the lower sprocket wheel. In one form, the grippers are disposed on the respective sprocket wheel, which in turn are disposed behind the front plate.

The shape and size of the grippers may vary widely. As noted herein, the grippers may work to convey the stalk through a leaf stripping assembly and the feed opening. In one form, the grippers are in the form of spikes. In one form, the grippers are in the form of teeth. In one form the grippers are in the form of ridges. These forms of grippers are merely exemplary and are not meant to limit the scope of the claimed assembly and/or method. In some cases, a plurality of the grippers, e.g., spikes, teeth, and/or ridges, is disposed on the circumference of upper and/or lower sprocket wheels. In use, the grippers may bite into a stalk. Upon movement, e.g., rotation, of the sprocket wheels, the stalk is pulled through the leaf removal assembly.

In some cases, at least one of the upper sprocket wheel and the lower sprocket wheel are adjustably attached to the frame. As discussed above, the adjustable attachment of the upper sprocket wheel and/or the lower sprocket wheel allows the sprocket wheel(s) to move vertically or arcuately relative to one another, which allows the spatial relationship between the sprocket wheels to vary and/or to be adjusted. As one example, at least one of the upper sprocket wheel and the lower sprocket wheel has a pivotal attachment to the frame. The use of the pivot provides for smooth movement of the respective wheel, which results in highly effective adjustment of the spatial relationship between the sprocket wheels.

In one form, the lower sprocket wheel is rotatably fixed within the frame and the upper sprocket wheel is rotatably carried in a pivot-able cradle, having pivot points on either side wall of the cradle, where it attaches to the frame of the leaf removal assembly. In another form, the pivot points are located at ends of a pivot shaft passing across and through a support (a pivot tube) on the back side of the cradle. The pivot tube attaches to both side walls of the cradle and the pivot shaft penetrates or otherwise attaches to the side walls of the leaf removal assembly, such that the cradle is mounted pivotally within the leaf removal assembly frame, being able to pivot about the pivot shaft on the pivot tube. Thus, the upper sprocket wheel is free to move with the cradle and pivot away from the lower sprocket wheel, mounted in the leaf removal assembly frame. Of course, this configuration could be easily reversed, such that the lower sprocket wheel is pivotally mounted in a similar manner.

In one form, one or more of the sprocket wheels are rotatable. In one form, the rotation of the one of more of the sprocket wheels is motorized. In some forms, the rotation of the one of more of the sprocket wheels may be hand operated. Advantageously, the sprocket wheels may be geared together so as to cooperatively rotate to pull a tobacco stalk into and through the leaf removal assembly.

In one form, the sprocket wheel(s), e.g., at least one of the sprocket wheels, is/are adjustable such that at least one of the upper sprocket grippers is engaged with at least one of the lower sprocket grippers. Such a configuration may be beneficial when a particularly small stalk is being processed. In this case, the close spatial relationship of the sprocket wheels (and the respective grippers) allows a small stalk to be contacted and pulled through the feed opening and conveyed into the interior of the leaf removal assembly. In a conventional fixed sprocket wheel assembly, the smaller stalk might be too small to be contacted by fixed wheels and not be conveyed into the interior of the leaf removal assembly. In another form, the sprocket wheel(s), e.g., at least one of the sprocket wheels, is/are adjustable such that at least one of the upper sprocket grippers can be spaced apart from at least one of the lower sprocket grippers. Such a configuration may be beneficial when a particularly large stalk is being processed. In this case, the relatively distant spatial relationship of the sprocket wheels (and the respective grippers) allows a larger stalk to be pulled through the feed opening and conveyed into the interior of the leaf removal assembly. In a conventional fixed sprocket wheel assembly, the larger stalk could be too large to fit between the fixed wheels and the wheels could become jammed. These examples are intended to demonstrate the versatility of the claimed assembly and process and the ability to handle varying sizes of stalks. The examples are not meant to be limiting.

As noted above, the upper sprocket wheel and/or the lower sprocket wheel may be attached, e.g., adjustably attached, within the frame and the adjustable attachment allows the location of the sprocket wheel(s) to be varied. In some forms, the leaf removal assembly may further comprise a sprocket controller. The sprocket controller controls and/or adjusts the location of the respective sprocket wheel (s), at least one of which is adjustably attached within the frame. In one form, the sprocket controller is in communication with a respective sprocket wheel, which provides the ability for the sprocket controller to control and/or adjust the respective sprocket wheel.

Any suitable control device may be employed as a sprocket controller. For example, the sprocket controller may comprise a spring loaded device. In one form, one end of a spring device may be attached to the frame and the other may be attached to or biased against the cradle carrying the upper sprocket wheel. The location of the sprocket wheel may be controlled by the spring, such as by the tension or compression applied to the spring. In another form, the sprocket controller may be a pneumatic or hydraulic device, and the pneumatic or hydraulic device may be in contact with the sprocket wheel. The pneumatic or hydraulic device may be extended or retracted so as to control or adjust the location of the sprocket wheel. Of course, these forms are merely exemplary and are not meant to limit the scope of the claimed apparatus and/or process.

According to this adjustable attachment, the sprocket wheels are able to float to some extent relative to one another, such that once the sprocket controller has been adjusted to accommodate a particular sized stalk, the moveable sprocket wheel is biased towards the fixed sprocket wheel to a distance sufficient to accommodate small diameter stalks, but with enough flexibility to accommodate larger diameter stalks, such as by the cradle pivoting to create a greater distance between the sprocket wheels/grippers. Accordingly, constant adjustment of the distance between the sprocket wheels is avoided, improving the efficiency of the leaf stripping operation. Upon encountering a stalk which is too large to be accommodated at the current adjustment setting, the operator can merely readjust the sprocket controller to decrease the bias pressure of the adjustable sprocket wheel, so as to move the respective sprocket wheels a little further apart, the reverse being true regarding stalks too small in diameter.

The frame, in some forms, may define a movement path opening that allows for movement of the upper sprocket wheel and/or the lower sprocket wheel. In some forms, the movement path opening may be cut into the frame (or portions thereof). In one form, the movement path allows for substantially vertical, e.g., vertical, movement of the respective sprocket wheel. In one form, the movement path allows for substantially arcuate movement of the respective sprocket wheel, such as that caused by pivoting of the upper sprocket wheel cradle, discussed above. Since the arcuate movement of the sprocket wheel is relatively small, it can be accommodated by movement paths (i.e. slots in the leaf removal assembly frame) which are slightly wider than would be necessary for strictly vertical movement. For example, the width of the movement paths should be greater than the diameter of the sprocket wheel axles extending through them.

In some forms, the leaf removal assembly further comprises a lever arm. The lever arm may be connected to the pivot-able cradle carrying the upper sprocket wheel or lower sprocket wheel. The lever arm may be employed to separate, e.g., manually pivot, the upper sprocket wheel away from the lower sprocket wheel, so as to clear the occasional jam if a stalk having an extremely large or oversized diameter is fed into the leaf separator assembly.

In one form, the leaf stripping assembly may comprise one or more separate components. The front plate may have a separate leaf stripping assembly attached in front of the feed opening. The leaf stripping assembly may provide an inlet through which cured tobacco, e.g., stalks with leaves and/or branches attached thereto, may be fed so as to be conveyed to additional components of the leaf removal assembly. When the cured tobacco is conveyed through the leaf stripping assembly, the leaves or branches of the cured tobacco engage cutting edges or blades, which cause the leaves or branches to be severed from the stalk. The size of the aperture in the leaf stripping assembly may vary widely.

In one form, the leaf stripping assembly has a variable aperture and may comprise at least one adjustably attached stripping plate, or multiple stripping plates, e.g., four stripping plates, each having a cutting edge, which can create an adjustable stripping aperture to allow for cleaner removal of the leaves or branches from the stalk. The stripping plates may be mounted, e.g., adjustably mounted or flexibly mounted to the front plate. In one form, the stripping plates are slidably-mounted within an underlying frame and spring-loaded toward a central aperture, enabling them to accommodate varying stalk diameters. In one form, the stripping plates are mounted via a pneumatic or hydraulic device. Thus, the four stripping plates form an adjustable stripping aperture through which the stalk is conveyed. The size of the stripping aperture is adjustable in that, as the one or more stripping plates adjusts or flexes, the size of the stripping aperture changes accordingly. In one form, in operation, the stripping plates slide perpendicular to the axis of a stalk being conveyed through the leaf removal assembly. The sliding nature of the stripping plates allows for effective removal of leaves or branches from the stalk even when stalk diameters are inconsistent or when bumps or other protrusions are present on a stalk.

Each stripping plate may comprise a guide shoe attached to the back of the plate, that is configured flush or substantially flush with a cutting surface of the stripping plate. The guide shoe, generally extending slightly beyond the cutting edge of the stripping plate, serves to guide the stripping plate along the stalk (and the inconsistencies thereof) as the stalk is conveyed through the stripping aperture. As a result, the leaves or branches are severed from the stalk with minimal scraping or cutting of the stalk. The guide shoe may be adjustably attached to the stripping plate, e.g., the guide shoe may be mounted such that the portion of the shoe extending beyond the cutting edge of the stripping plate may be varied. As the guide shoe moves or floats to follow the outer surface of the stalk, the stripping plate(s) move in conjunction with the guide shoe(s), which in turn varies the size of the stripping aperture to conform to the stalk diameter. In one particularly advantageous form, the cutting edges of the stripping plates are arcuate in shape, such as concave, to more closely follow the circumference of the tobacco stalk passing through them.

In some forms, the leaf removal assembly may further comprise a shredder. The shredder may serve to shred at least a portion of a stripped stalk. In one form, the shredder is employed to shred at least a portion of a stalk that has been processed in the leaf removal assembly. However, unprocessed stalks may also be shredded in the shredder. The shredded stalks may be utilized, for example, in the tobacco production process. As another example, the shredded stalks may be utilized as fertilizer. The shredded stalks may also be simply discarded.

The shredder may be configured downstream of the feed opening, such as downstream of one of more of the sprocket wheels. In use, the shredder may receive a processed stalk, e.g., a stripped stalk, which has been conveyed past the cutting edge and through the feed opening. In one form, the shredder may employ a shredding system, e.g., a rotating head system, on which is mounted one or more blades, e.g., knives, utilized to shear or cut at least one stalk portion from the whole stalk. The shredding system may be driven by a motor, e.g., an electric motor. As another example, the shredding system may be driven by hand operation. The shredded stalk portions may be gathered and further process and/or disposed.

In another form, a process for separating a leaf from a stalk is disclosed. The process may comprise the step of providing a leaf removal assembly as discussed herein. The process may further comprise the step of feeding a stalk end through a leaf stripping assembly, the feed opening and toward the sprocket wheels. In one form, the upper sprocket wheel/gripper and/or the lower sprocket wheel/gripper may engage at least a portion of the stalk. The process may further comprise the step of rotating at least one of the upper sprocket wheel and the lower sprocket wheel. In doing so, the stalk is moved, e.g., conveyed, through the feed opening. As a result, the leaves on the stalk engage a cutting edge of a leaf stripping assembly in front of the feed opening and are removed from the stalk.

In some forms, the feeding of the stalk comprises feeding a stalk end through the feed opening and toward the sprocket wheels and adjusting the location of the upper sprocket wheel and/or the lower sprocket wheel. The adjustment of the sprocket wheel(s) advantageously allows better engagement of the stalk end with the respective wheel(s). The adjusting of the location of the sprocket wheel(s), which allows variance in the spatial relationship between the upper sprocket grippers and the lower sprocket grippers. Adjusting of the location of the sprocket wheel(s) and their respective grippers beneficially allows the leaf removal assembly to process stalks having a wide range of stalk sizes without the need for additional sorting and/or removal mechanisms.

Referring now to the FIGS., FIG. 1 is a perspective view of one form of a leaf removal assembly. The form of FIG. 1 shows a front plate and a leaf stripper assembly in an exploded view. As shown in FIG. 1, leaf removal assembly 100 comprises frame 102, which supports additional components of leaf removal assembly 100. FIG. 1 shows upper sprocket wheel 104 and lower sprocket wheel 106, at least one of which is adjustably attached to and/or supported by frame 102. Upper sprocket wheel 104 comprises a plurality of upper socket grippers 110. Lower sprocket wheel 106 comprises a plurality of lower sprocket grippers 112. FIG. 1 shows the grippers as being teeth, however, other forms of grippers are entirely within the contemplation of the leaf removal assembly. Preferably each gripper 110, 112 extends radially outwardly from the respective sprocket wheel.

Front plate 108 is shown in FIG. 1 in an exploded view. In use, front plate 108 is attached to and/or supported by frame 102. Front plate 108 has a feed opening 116, through which stalks are fed (toward sprocket wheels 104, 106). In this form, a leaf stripping assembly 115 comprising a cutting edge 114 positioned on a mounting plate, is mounted in front of feed opening 116 on the front plate 108.

Figure 4:
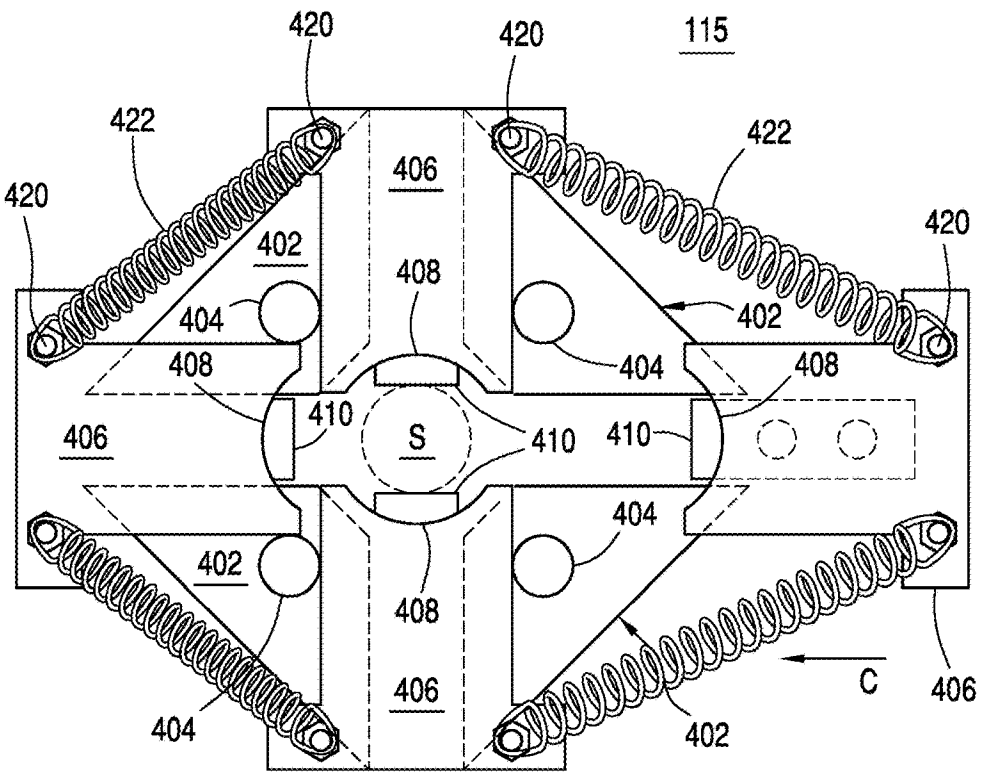
FIG. 4 presents a front view of a leaf stripping assembly having a variable aperture for accommodating different diameter tobacco stalks in accordance herewith.

In use, a stalk may be fed toward the grippers 110, 112. Upon contacting the grippers 110, 112, the stalk is conveyed, e.g., pulled, through front plate 108. When the cured tobacco is conveyed through the feed opening, the leaves or branches of the cured tobacco engage cutting edges 114 of leaf stripping assembly 115, which cause the leaves or branches to be severed from the stalk. The size of the aperture formed between the cutting edges 114 may be variable or changeable by incorporating the cutting edges 114 on moveable plates, such as sliding plates (FIG. 4).

At least one of upper sprocket wheel 104 and lower sprocket wheel 106 is adjustably attached to frame 102, which allows the spatial relationship between sprocket wheels 104, 106 to vary and/or to be adjusted. Frame 102 defines movement paths 126, illustrated as slotted openings that allow for movement of upper sprocket wheel 104 and/or lower sprocket wheel 106 and their respective axles. It is understood that co-acting movement path(s) 126 are disposed on the opposite side of frame 102. As shown in FIG. 1, movement paths 126 allow for both vertical and lateral movement of the respective sprocket wheel 104, 106, generally in the direction of arrow A. The lateral movement path is necessary to accommodate the slight arcuate movement of the adjustable sprocket wheel upon pivoting of the cradle 302 (FIG. 3) in which it is held.

Sprocket wheels 104, 106 are rotatable. In one form, the rotation of the one of more of the sprocket wheels is effected via motor 118 and gearbox 119. In other forms, the rotation of the one of more of the sprocket wheels may be effected by hand.

Figure 3:
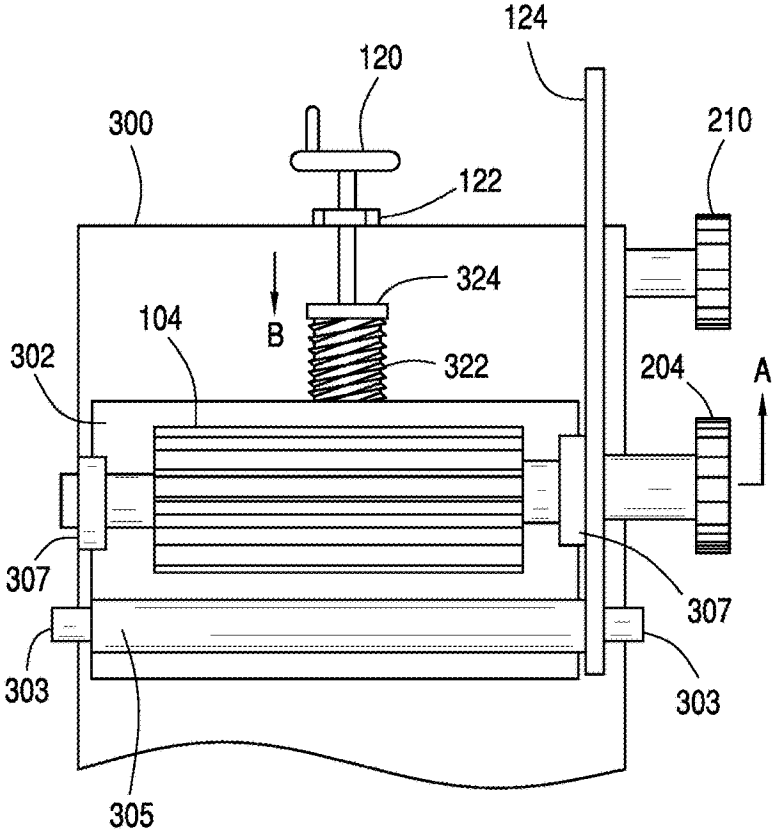
FIG. 3 presents a rear view of an upper portion of a leaf removal assembly in accordance herewith.

Leaf removal assembly 100 further comprises sprocket controller 120, in this form threaded through a captive hex nut 122. As illustrated in FIG. 1, sprocket controller 120 controls and/or adjusts the location of the sprocket wheel 104 utilizing spring loaded device 322 (FIG. 3). Leaf removal assembly 100 further comprises lever arm 124. Lever arm 124 is operatively connected to upper sprocket wheel 104, such as to cradle 302, and may be employed to separate, e.g., manually pivot, upper sprocket wheel 104 from the lower sprocket wheel 106. The leaf removal assembly may also include a cover or housing 300 attached to frame 102 to enclose the moving parts of the assembly for safety, and a shredder 600, both discussed in more detail below.

Figure 2:
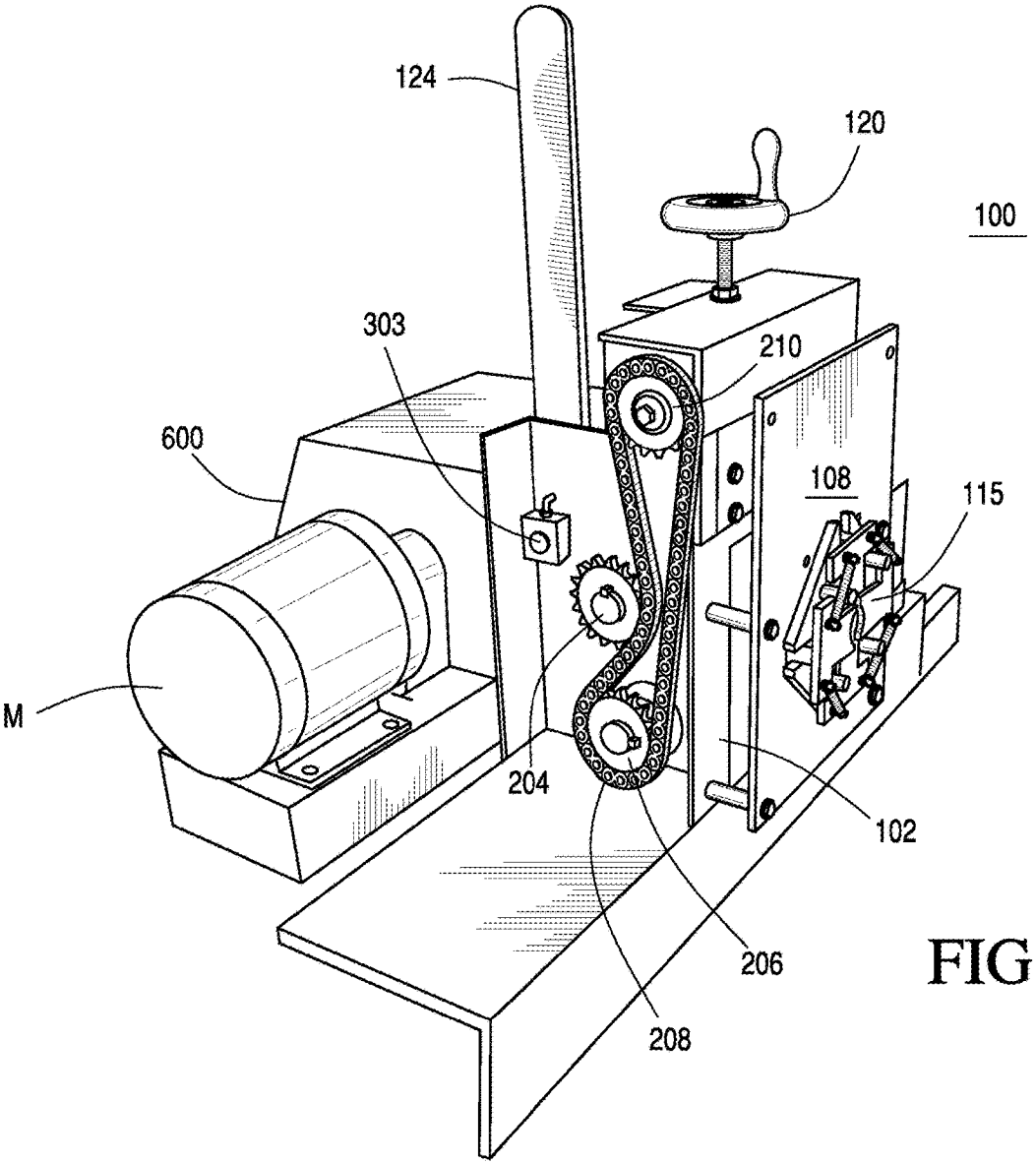
FIG. 2 presents an opposite side view of the leaf removal assembly of FIG. 1.

FIG. 2 presents an opposite side view of the leaf removal assembly 100 of FIG. 1, with front plate 108 and leaf stripping assembly 115 shown installed on frame 102. Sprocket wheels 104, 106 are advantageously geared together, or driveably connected by a gear 206 and roller chain 208 combination at one end of the respective sprocket wheel axles. In one form, the gear/roller chain assembly has an idler gear 210 mounted above gear 206. Gear 206 is driven by motor 118 and gearbox 119 through lower sprocket wheel 106, and the roller chain 208 is wrapped around and against the front of gear 204, resulting in driving upper sprocket wheel 104 in a direction counter to that of sprocket wheel 106. This counter-rotation of the upper and lower sprocket wheels 104, 106 acts to draw stalks into the leaf removal assembly 100 and past leaf stripping assembly 115. Also shown in FIG. 2 are the relative positions of shredder assembly 600 and its driving motor M, as well as pivot shaft 303 (FIG. 3).

FIG. 3 presents a rear view of a top portion of the leaf removal assembly, which comprises a housing 300 mounted on frame 102 (not shown) and upper sprocket wheel 104, housed within cradle 302, which is supported within the frame by pivot shaft 303 and pivot tube 305. Pivot tube 305 is connected to each lateral side wall of cradle 302 toward the rear thereof, so as to not interfere with rotation of upper sprocket wheel 104, which itself is held within cradle 302 by bearings 307 on either lateral wall of cradle 302, with the axle of sprocket wheel 104 extending on either side into movement paths 126 in frame 102 (FIG. 1). Pivot shaft 303 runs through pivot tube 305 and penetrates both lateral walls of leaf removal assembly frame 102, supporting cradle 302 within frame 102. Lever arm 124 is also attached to one lateral wall of cradle 302, such as by welding, bolts or the like.

Accordingly, cradle 302 and upper sprocket wheel 104 can move around pivot shaft 303, thus moving the axle ends of sprocket wheel 104 substantially vertically, or more properly in a slightly arcuate direction in movement paths 126, either toward or apart from lower sprocket wheel 106 (FIG. 1). Such movement can be effected either by rotation of sprocket controller 120 inside captive hex nut 122, thus forcing spring 322 to bias cradle housing 302 downward in the direction of arrow B, by pressing washer 324 to compress spring 322, or upward in the direction of arrow A by releasing compression from spring 322.

As discussed above, the leaf removal assembly 100 can occasionally jam if too large a stalk is processed, in which case lever arm 124 can be manually pulled backward to pivot cradle 302 relative to the housing 300 (and the frame 102) and to separate upper sprocket arm 104 from lower sprocket arm 106, enabling removal of the jammed stalk.

FIG. 4 presents a front view of variable aperture leaf stripping assembly 115, which comprises a four piece frame 402, each piece having a mounting post 404. Mounting posts 404 act to partially guide and restrain (substantially "T"-shaped) stripping plates 406 into engagement with a stalk S in a variable central aperture formed by arcuate cutting edges 408 of each stripping plate. Thus, when the stripping plates 406, which overlap (FIG. 4), are engaged with stalk S, the mounting posts help restrain the stripping plates from lateral movement as cutting edges 408 strip leaves from stalk S, moving into the direction of the page during the stripping process.

In order to avoid cutting edges 408 from coming into direct contact with stalk S, thereby cutting into the stalk, each stripping plate 406 is provided with a guide shoe 410, which is attached (e.g. bolted) to the back of the stripping plate (shown in phantom lines on right stripping plate). One end of the guide shoe extends slightly beyond the cutting edge 408 of the stripping plate 406, the amount of which extension can be adjusted in advance. The guide shoes 410 cooperate to follow the peripheral surface of the stalk, such that cutting edges 408 are slightly offset from the stalk and positioned to cut the leaves from the stalk with minimal cutting into the stalk itself.

Figure 5:
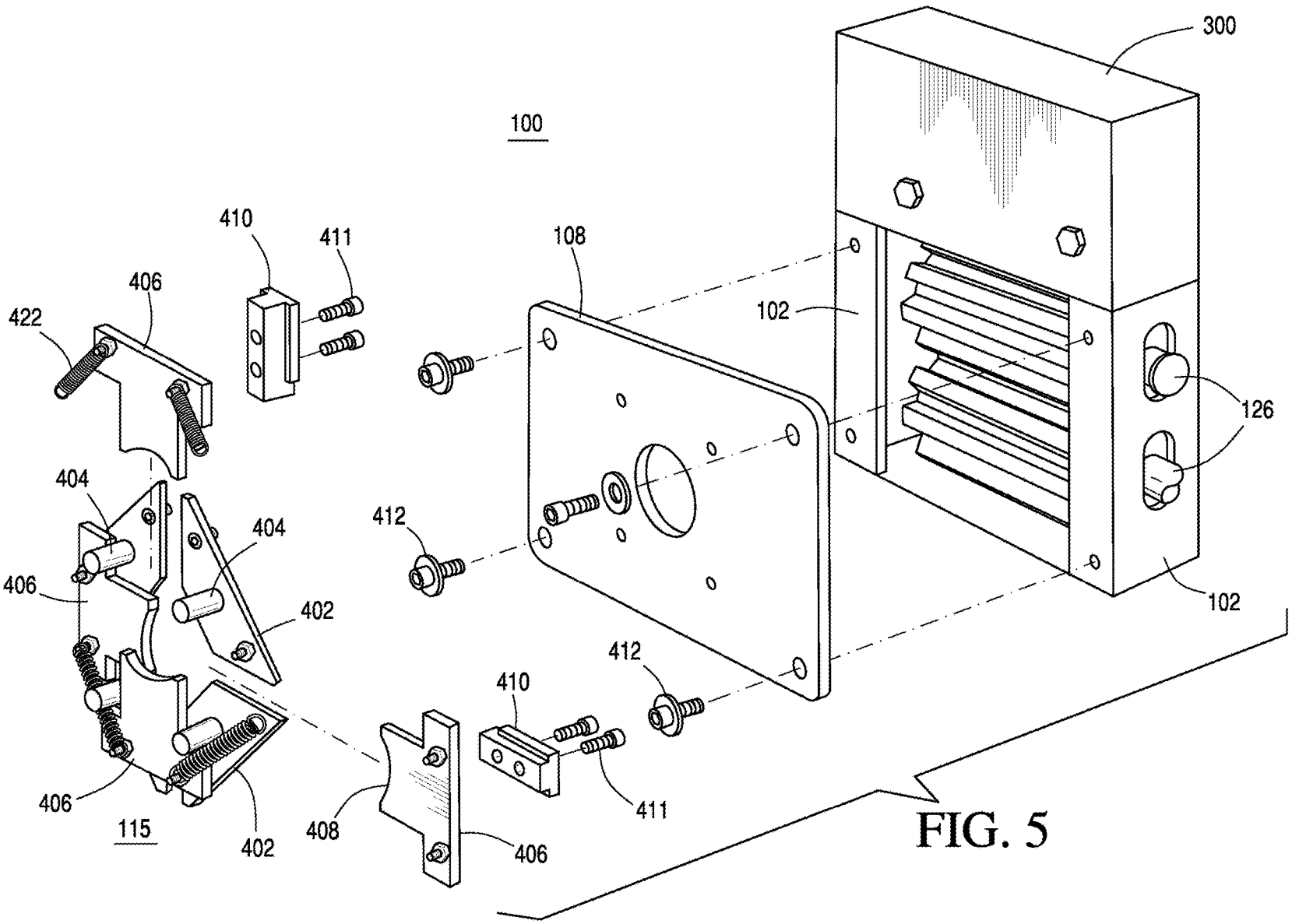
FIG. 5 presents an exploded view of the variable aperture leaf stripping assembly of FIG. 4 and the front panel as positioned relative to the remainder of the leaf removal assembly in accordance herewith.

Advantageously, the portions of guide shoes 410 extending from the back sides of stripping plates 406 are structured to fit into the slots between the pieces of the stripping plate frame 402, so as to radially guide the stripping plates 406 to form the variable aperture through which stalk S progresses for stripping (see also FIG. 5).

Each stripping plate 406 has two guide posts 420 mounted on the end opposite the arcuate cutting edges 408. Likewise, each guide post 420 is connected to the guide post 420 immediately adjacent to it on the next stripping plate with a spring 422, such as an extension spring, which in combination act to bias stripping plates 406 radially inward, generally in the direction of arrow C, to form the variable central aperture around stalk S.

FIG. 5 presents an exploded view of leaf removal assembly 100, showing the general configuration of front plate 108 and variable aperture leaf stripping assembly 115. In this exploded view, the relative locations of stripping plates 406 and guide shoes 410 are more clearly shown. As stated above, guide shoes 410 can be bolted 411 onto the back sides of the stripping plates 406. This view also better shows the overlapping structure of stripping plates 406 and their respective cutting edges 408, and how they fit between mounting posts 404. The combination of front plate 108 and variable aperture leaf stripping assembly 115 are further bolted 412 onto frame 102 to form leaf removal assembly 100.

Figure 6A:
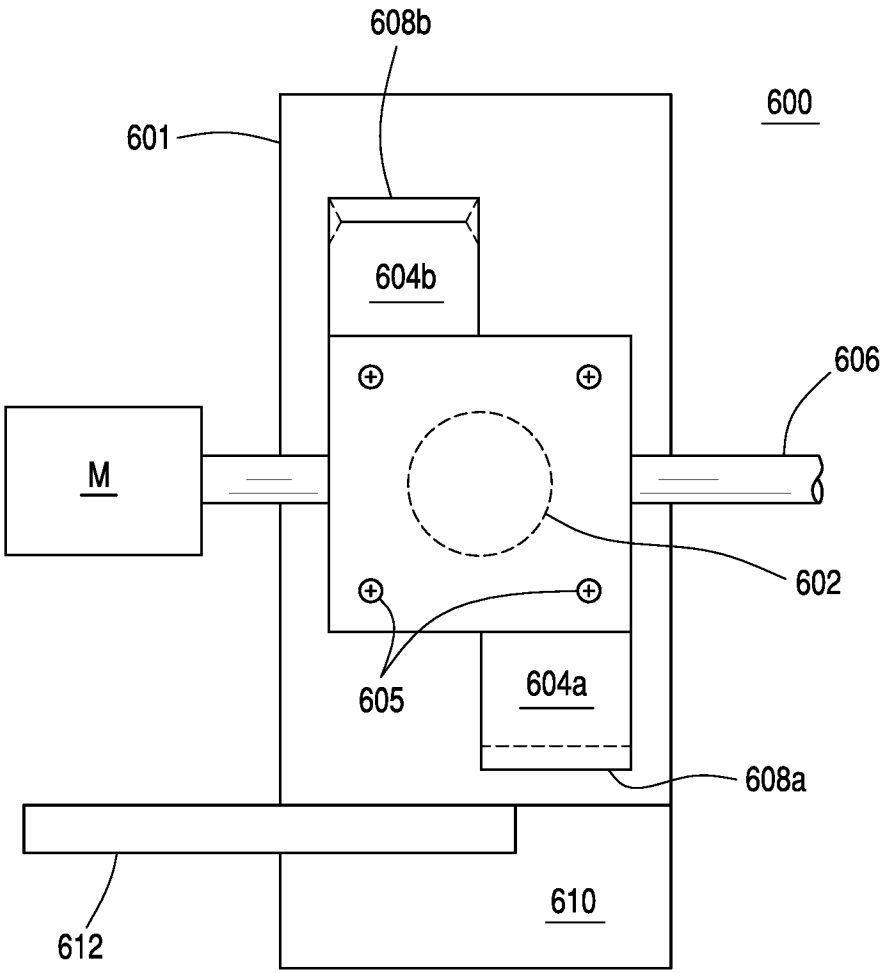
FIGS. 6A and 6B present cutaway front and side views of a stalk shredder assembly useful with the leaf removal assembly of the present invention in accordance herewith.
Figure 6B:
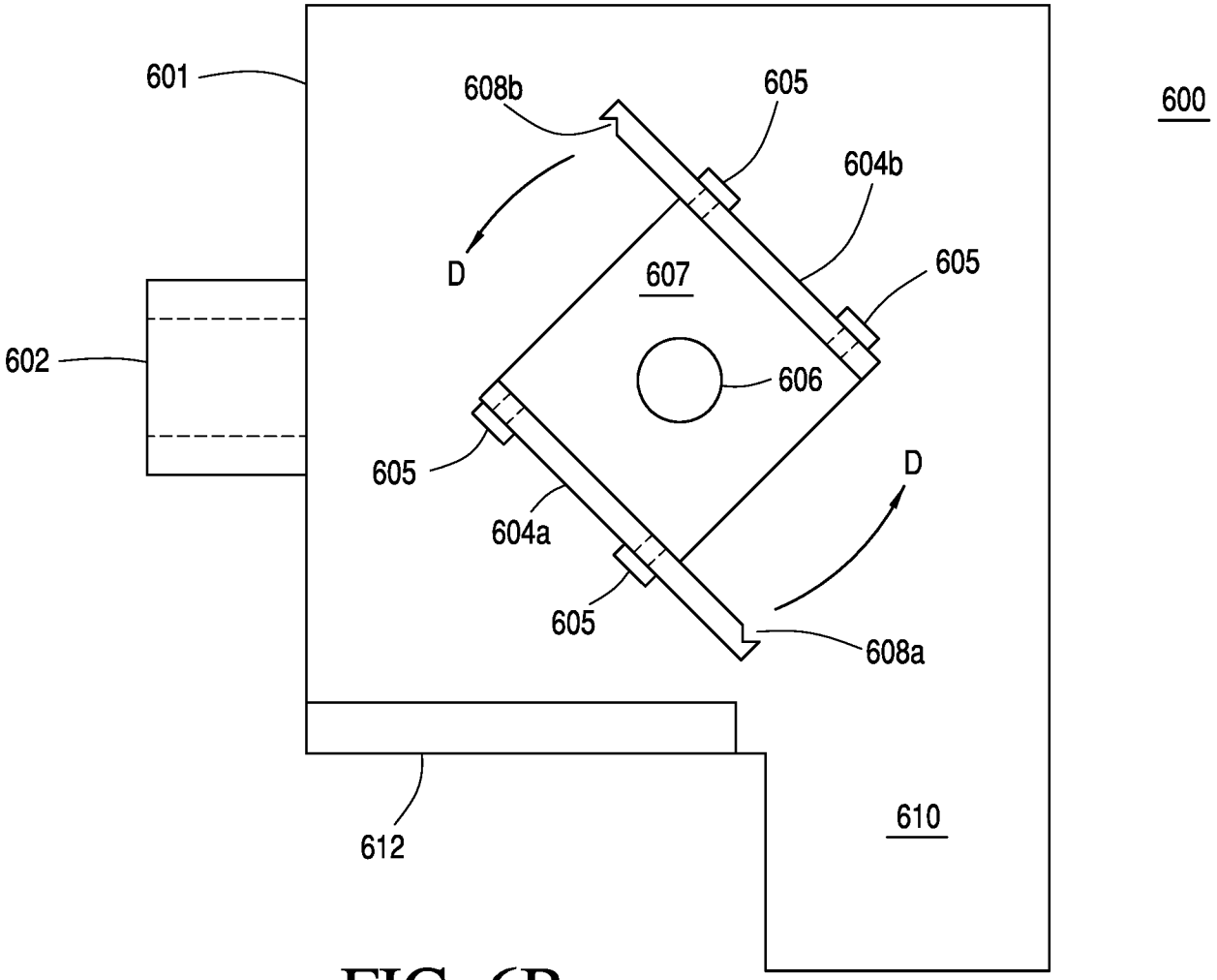

FIGS. 6A and 6B present cutaway front and side views, respectively, of a stalk shredder assembly 600 useful with the leaf removal assembly of the present invention, which can be positioned downstream of sprocket wheels 104 and 106. The stalk shredder assembly 600 is generally supported on a support bracket 612, powered by motor M and is positioned within a housing 601, which has positioned on its upstream face a stalk entry tube 602, the relative position of which is shown in phantom lines on FIG. 6A. Stalks which have been previously stripped of their leaves by the leaf removal assembly are advanced through stalk entry tube 602 and directed toward rotating knife blades 608*a* and 608*b*. In FIG. 6A knife blade 608*b* is facing "forward"; i.e. out of the page, while knife blade 608*a* should be understood to be facing "rearward"; i.e. into the page. In one form, knife blades 608*a* and 608*b* are each part of separate knife blade mounting plates 604*a* and 604*b* respectively, disposed on and fixed to opposite sides of rotating head assembly 607 by mounting screws 605, the individual blades 608*a* and 608*b* extending from their respective mounting plates 604*a* and 604*b*.

In one form, knife blades 608*a* and 608*b* are structured to be only one half the width of their respective mounting plates 604*a* and 604*b*. In this way the positive pressure produced by the rapid rotation of the knife blades within the housing 601 is greatly reduced as compared to using full-width blades, thereby reducing blow-back of shredded stalks through entry tube 602 and enhancing deposition of the shredded stalk parts into waste bin 610, downstream of and below the knife blade assembly 604*a* and 604*b*, 607, 608*a* and 608*b*.

Rotating head assembly 607 is mounted in communication with drive shaft 606, which is driven by motor M during the shredding process. In FIG. 6B, which is a cutaway side view of shredder assembly 600, the relationship between stalk entry tube 602 and shredder blades 608*a* and 608*b* can be more clearly seen. During the shredding process, a stripped stalk is conveyed out of leaf removal assembly 100 by the rotating sprocket wheels 104, 106, and into stalk shredder assembly 600 through entry tube 602. As the stripped stalk progresses, it comes into contact with rotating knife blades 608*a* and 608*b*, which are rotating in the direction of arrows D, is shredded, and then directed toward and into waste bin 610, which can be emptied as needed.

Figure 7:
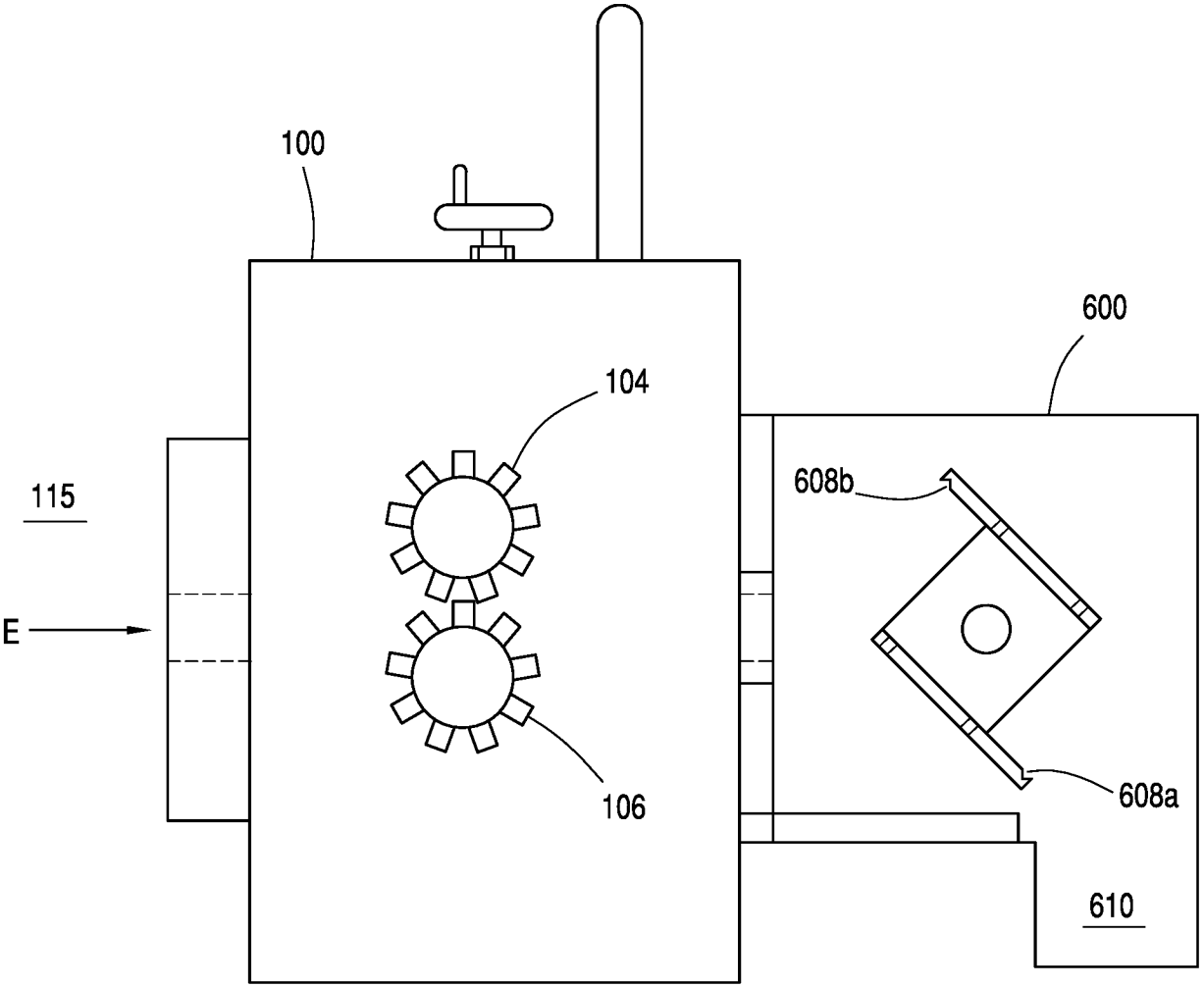
FIG. 7 presents a partially cutaway overall plan view of the entire leaf separator/stalk shredder assembly in accordance herewith.

FIG. 7 presents a partially cutaway, overall side view of the combination leaf separator/stalk shredder assembly of the present invention. During the process, a leafy stalk is directed into the assembly in the direction of arrow E, through leaf stripping assembly 115, where the leaves are stripped from the stalk. The stripped stalk is pulled through the assemblies by rotating sprocket wheels 104, 106, then forced into shredder assembly 600 and into contact with rapidly rotating knife blades 608*a* and 608*b*. The shredded remains are deposited and collected in waste bin 610 for subsequent disposal.

Illustrative, non-exclusive examples of systems and methods according to the present disclosure have been presented. It is within the scope of the present disclosure that an individual step of a method recited herein, including in the following enumerated paragraphs, may additionally or alternatively be referred to as a "step for" performing the recited action.

INDUSTRIAL APPLICABILITY

The assemblies and processes disclosed herein are applicable to the tobacco industry, in particular that portion directed to production of products for smoking enjoyment.

While the invention has been described in detail, modifications within the spirit and scope will be readily apparent to those of skill in the art. In addition, it should be understood that aspects and portions of various forms and various features recited below and/or in the appended claims may be combined or interchanged either in whole or in part. In the foregoing descriptions of the various forms, those forms which refer to another form may be appropriately combined with other forms as will be appreciated by one of skill in the art. Furthermore, those of ordinary skill in the art will appreciate that the foregoing description is by way of example only, and is not intended to be limiting.

We claim:

1. A method of removing leaf from a collection of stalks of different sizes, the method comprising:

stripping leaf from each stalk by feeding each stalk through a stripping mechanism, the stripping including, drawing each stalk between opposing, radially moveable, rotationally fixed cutting edges while biasing the cutting edges radially inward, and abating cutting of each stalk by limiting radial inward movement of the cutting edges by contacting a stem during the drawing step with a portion of a guide shoe that moves with and extends radially inwardly beyond each cutting edge, and the feeding including, gripping an end portion of each stalk between a pair of opposing, rotating grippers while biasing one of the grippers toward the other gripper, the pair of opposing, rotating grippers on an upper wheel and a lower wheel that are rotatably fixed within a cradle housing, the cradle housing extending at least a length of the upper wheel and the lower wheel;

upon an occurrence of a jam from a first stalk, relieving the jam by moving one of the grippers away from the other, while continuing the biasing; and the feeding further comprising continuously rotating the grippers throughout the gripping, biasing and relieving.

2. The method of claim 1, wherein the stripping mechanism comprises a spring configured to bias the cutting edges radially inward.

3. A method of removing leaf from a collection of stalks of different sizes, the method comprising:

stripping leaf from each stalk by feeding each stalk through a stripping mechanism, the stripping including drawing each stalk between opposing, radially moveable, rotationally fixed cutting edges while biasing the cutting edges radially inward, and the feeding including, gripping an end portion of each stalk between a pair of opposing, rotating grippers while biasing one of the grippers toward the other gripper, the pair of opposing, rotating grippers on an upper wheel and a lower wheel that are rotatably fixed within a cradle housing, the cradle housing extending at least a length of the upper wheel and the lower wheel;

upon an occurrence of a jam from a first stalk, relieving the jam by moving one of the grippers away from the other, while continuing the biasing; and the feeding further comprising continuously rotating the grippers throughout the gripping, biasing and relieving.

4. The method of claim 3, wherein the stripping further includes abating cutting of each stalk by limiting radial inward movement of the cutting edges by contacting a stem during the drawing step with a portion of a guide shoe that moves with and extends radially inwardly beyond each cutting edge.

5. The method of claim 4, wherein the stripping mechanism comprises a spring configured to bias the cutting edges radially inward.

6. A method of removing leaf from a collection of stalks of different sizes, the method comprising:

stripping leaf from each stalk by feeding each stalk through a stripping mechanism, the feeding including gripping an end portion of each stalk between a pair of opposing, rotating grippers while biasing a first gripper of the pair of grippers toward a second gripper of the pair of grippers and while biasing the second gripper toward the first gripper, the pair of opposing, rotating grippers on an upper wheel and a lower wheel that are rotatably fixed within a cradle housing, the cradle housing extending at least a length of the upper wheel and the lower wheel;

upon an occurrence of a jam from a first stalk, relieving the jam by moving one of the grippers away from the other, while continuing the biasing; and the feeding further comprising continuously rotating the grippers throughout the gripping, biasing and relieving.

7. The method of claim 6, wherein the stripping includes drawing each stalk between opposing, radially moveable cutting edges while biasing the cutting edges radially inward.

8. The method of claim 7, wherein the stripping includes abating cutting of each stalk by limiting radial inward movement of the cutting edges by contacting a stem during the drawing step with a portion of a guide shoe that moves with and extends radially inwardly beyond each cutting edge.

9. The method of claim 8, wherein the stripping mechanism comprises a spring configured to bias the cutting edges radially inward.

10. The method of claim 7, wherein the cutting edges are configured to be rotationally fixed.

* * * * *